US005713832A

United States Patent [19]

Jain

[11] Patent Number: 5,713,832

[45] Date of Patent: Feb. 3, 1998

[54] MASSAGING FURNITURE WITH ELECTRIC VIBRATION DEVICE AND ECCENTRIC ROTOR

[75] Inventor: Anand Sagar Jain, Mississauga, Canada

[73] Assignee: Product Development Consulting Inc., Oakville

[21] Appl. No.: 635,164

[22] Filed: Apr. 23, 1996

[51] Int. Cl.[6] ..... A61H 1/00

[52] U.S. Cl. ..... 601/49; 601/58; 601/59; 601/60

[58] Field of Search ..... 601/46, 49, 56, 601/57, 58, 59, 60, 67, 69, 70

[56] References Cited

U.S. PATENT DOCUMENTS

| | | | |
|---|---|---|---|
| 2,235,184 | 3/1941 | Wettlaufer | 601/58 |
| 2,512,621 | 6/1950 | Emerson | 601/58 |
| 2,715,901 | 8/1955 | Blake | 601/67 |
| 2,980,108 | 8/1961 | Scott | 601/57 |
| 3,311,935 | 4/1967 | Petty | 601/59 |
| 3,628,528 | 12/1971 | Roberts | 128/57 |
| 3,653,375 | 4/1972 | Raffel | 128/33 |
| 3,799,154 | 3/1974 | Knop | 128/36 |
| 3,854,474 | 12/1974 | Carruth | 128/33 |
| 5,014,687 | 5/1991 | Raffel | 128/33 |
| 5,140,977 | 8/1992 | Raffel | 601/58 |
| 5,437,608 | 8/1995 | Cutler | 601/49 |

FOREIGN PATENT DOCUMENTS

| | | | |
|---|---|---|---|
| 2001388 | 4/1990 | Canada . | |
| 1378541 | 10/1964 | France | 601/59 |

*Primary Examiner*—Robert A. Hafer
*Assistant Examiner*—Benjamin K. Koo
*Attorney, Agent, or Firm*—Peter R. Hammond

[57] ABSTRACT

The present invention relates to a massaging device and vibrator for providing soothing vibrations to the body of a user. One aspect of the massaging device includes an article of furniture, a vibrator comprised of an electric motor with an eccentric rotor, and means for attaching the vibrator to the article of furniture so that the rotor rotates and induces vibrations in a plane that is parallel to the user contacting surface of the furniture. The vibrator itself is constructed to enable it to be easily attached to articles of furniture that are constructed in various ways from varying materials. A further aspect of the massaging device comprises a pad device having a soft, flexible, upper supporting surface, and a vibrating device with an eccentric rotor mounted in the pad device so that the rotor has an axis of rotation that is generally perpendicular to the upper supporting surface of the pad.

6 Claims, 9 Drawing Sheets

MASSAGING FURNITURE WITH ELECTRIC VIBRATION DEVICE AND ECCENTRIC ROTOR

BACKGROUND OF THE INVENTION

This invention relates to a massaging device and vibrator for applying vibration to the human body by means of one or more vibrating elements.

In the prior art, there are various vibrating massagers designed to vibrate the human body. For example, U.S. Pat. No. 5,437,608 issued Aug. 1, 1995 to S. Cutler discloses a massaging apparatus comprised of a cushion, pad or mattress including a plurality of vibrating transducers. The transducers each take the form of an electric motor that includes an eccentric weight mounted on its drive shaft so that a jiggling or oscillating motion is generated as the drive shaft is rotated. The motor is mounted so that the axis of rotation of the drive shaft is parallel to the surface being vibrated.

U.S. Pat. No. 5,014,687 issued May 14, 1991 to M. J. Raffel discloses a vibrator for mounting on furniture in which a pair of vibrator motors is each mounted to a resonator member capable of transmitting vibrations throughout a piece of furniture. The motor is a nonrotating vibrator motor having a coil and a movable pole piece and constructed and arranged to produce vibrations primarily perpendicular to the user contacting surface of the furniture.

U.S. Pat. No. 3,653,375 issued Apr. 4, 1972 to M. J. Raffel discloses a massaging chair comprised of two vibrators mounted on opposite sides of a chair frame below the seat. The vibrator motors are conventional vibrator motors having their shafts connected to eccentric weights. The vibrating motors are mounted on the frame so that the axis of rotation of the drive shafts is parallel to the user contacting surface of the chair.

These prior art massagers all provide for a vibrator motor that produces vibrations in a plane perpendicular or at a substantial angle to the body of the user who is using the massaging apparatus. In other words, the direction of the vibrations is not parallel with the plane of the user contacting surface. As a result, the vibrator motors of the prior art massagers impart a fast and repeated jerky motion onto the user contacting surface of the massager. Furthermore, the massage vibrations are concentrated in a relatively small area of the user contacting surface, with the result that the massaging effect is limited to local areas of the body of a user.

Additionally, the vibrating motor assembly disclosed in the prior art can sometimes be difficult to install in some types of furniture. For example, vibrating motors that are intended to be installed in furniture made of foam or similar materials may be difficult to install in furniture composed of a frame and spring type of construction.

It has been discovered that a massaging device and vibrator which induces vibrations in a plane parallel to the user contacting surface is desirable as it can provide more soothing massage vibrations that cover a large surface area. Additionally, a vibrator that has the flexibility to allow easy installation in different types of furniture that are constructed in a variety of ways is desirable.

SUMMARY OF THE INVENTION

According to one aspect of the invention, there is provided a furniture apparatus comprising an article of furniture for resting or sitting having a user supporting surface comprising flexible material covering a rigid rectangular frame, this frame having opposite frame elements which are interconnected by at least two sag resistant springs; at least one vibration device mounted in the article of furniture near the user surface and having an electric drive device; an eccentric rotor connected to the drive device and rotated thereby about an axis of rotation and a housing in which the drive device is mounted. The rotor encloses the drive device and the housing includes a guard extending circumferentially about the periphery of the rotor. The at least one vibration device is suspended between two of the sag-resistant springs by rigid wire members which connect the housing to the sag-resistant springs. The at least one vibrating device is mounted in the article of furniture so that the axis of rotation is generally perpendicular to the user supporting surface. During operation of the vibrating device, the device causes the user supporting surface to vibrate in directions parallel to the user supporting surface.

Preferably the vibrator is constructed in such a way as to allow it to be easily installed in furniture that is made from a variety of materials. For example, in one preferred embodiment, rigid wire members can be rotatably attached to the vibrator, thus enabling the vibrator to be easily attached to furniture that employs a rigid frame and sag-resistant spring style of construction. In another preferred embodiment, the vibrator can be secured in a cavity in an article of furniture that is formed of a resilient cushioning material such as foam.

According to another aspect of the present invention, a massaging device for providing massaging vibrations to the body of a person comprises a cushioned structure having a user contacting surface for supporting at least part of the body of a person, this cushion structure comprising flexible material covering a rigid rectangular frame having opposite frame elements which are interconnected by at least two sag-resistant springs. There are also a plurality of variable speed electric drive devices each having an eccentric rotor producing vibrations and a housing in which the drive device is mounted. Each housing and its respective drive device are suspended between two of the sag-resistant springs by two U-shaped rigid wire members, the base of each wire member being pivotably attached to a respective side of the housing and two ends of each wire member being attached to a respective one of the sag-resistant springs. A control mechanism is provided for controlling the speed of the drive devices. The housings are attached to the cushion structure so that each rotor rotates about an axis of rotation that is generally perpendicular to the user contacting surface. The rotor thereby induces an area of the user contacting surface to vibrate in directions substantially parallel to the user contacting surface.

Further features and advantages will become apparent from the following detailed description of the preferred embodiments taken in conjunction with the accompanying drawings.

DESCRIPTION OF PREFERRED EMBODIMENTS

Figure 1:
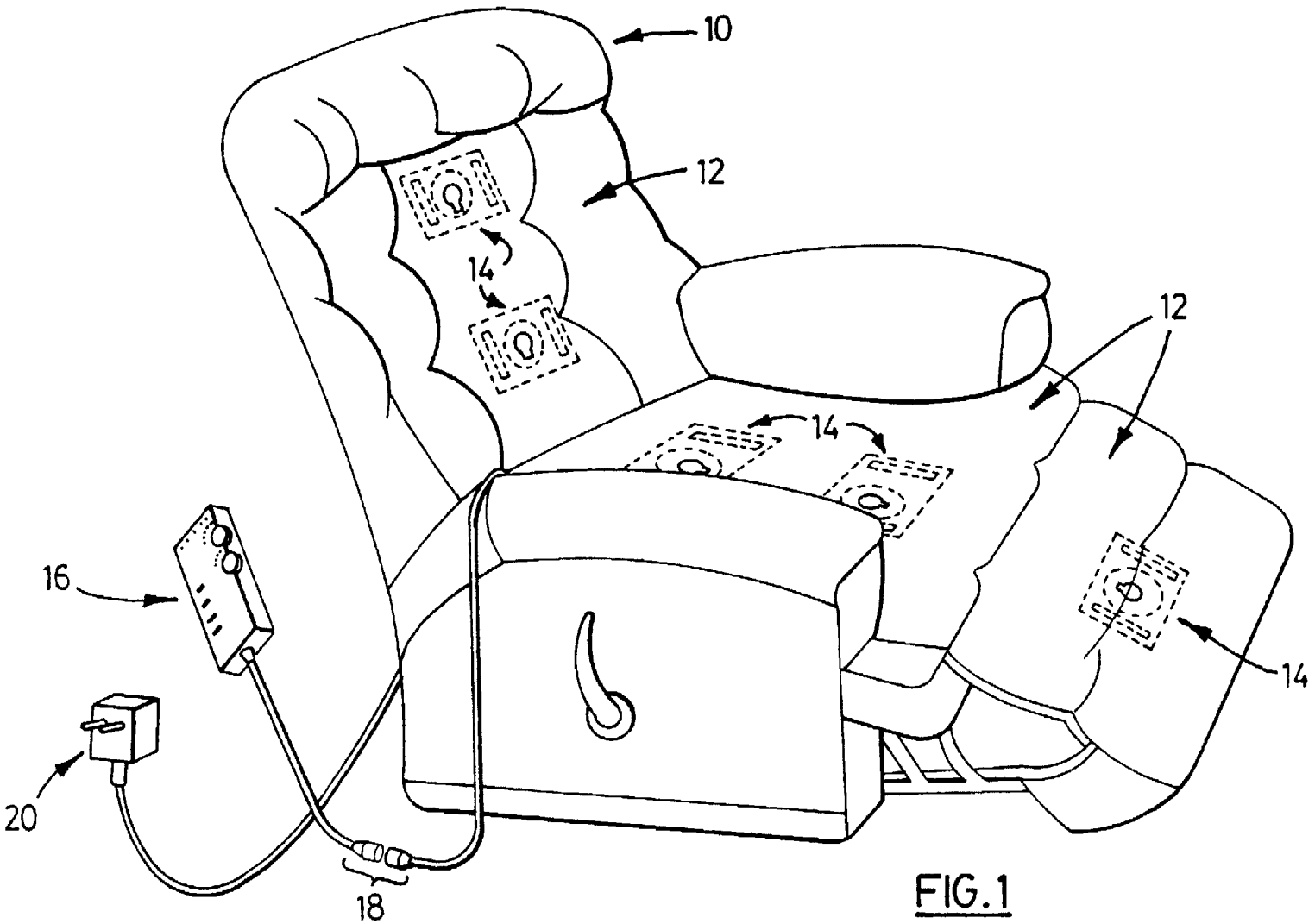
FIG. 1 is a perspective view of a chair equipped with massaging devices in accordance with a preferred embodiment of the present invention.

Referring to FIG. 1, there is illustrated a massaging device in accordance with a preferred embodiment of the present invention. The massaging device in the form of a chair 10 is comprised of a plurality of cushion structures 12 for supporting a person's body, a plurality of vibrators 14 installed in the cushion structures 12, a hand controller 16 to control the vibrators 14, and a power supply 20 for supplying power to the vibrators 14.

Figure 2:
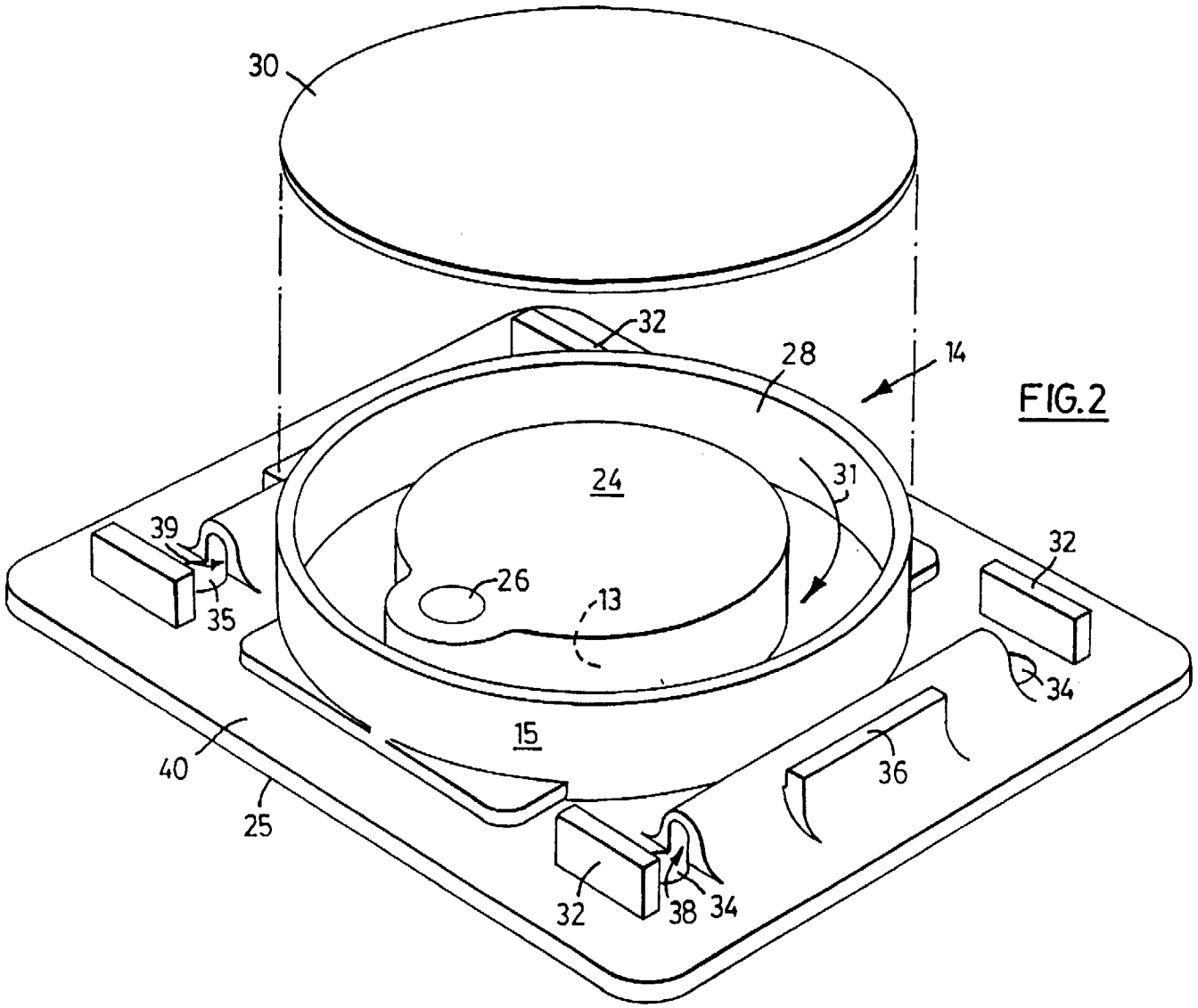
FIG. 2 is a perspective view illustrating one of the vibrators used in the chair of FIG. 1.
Figure 3:
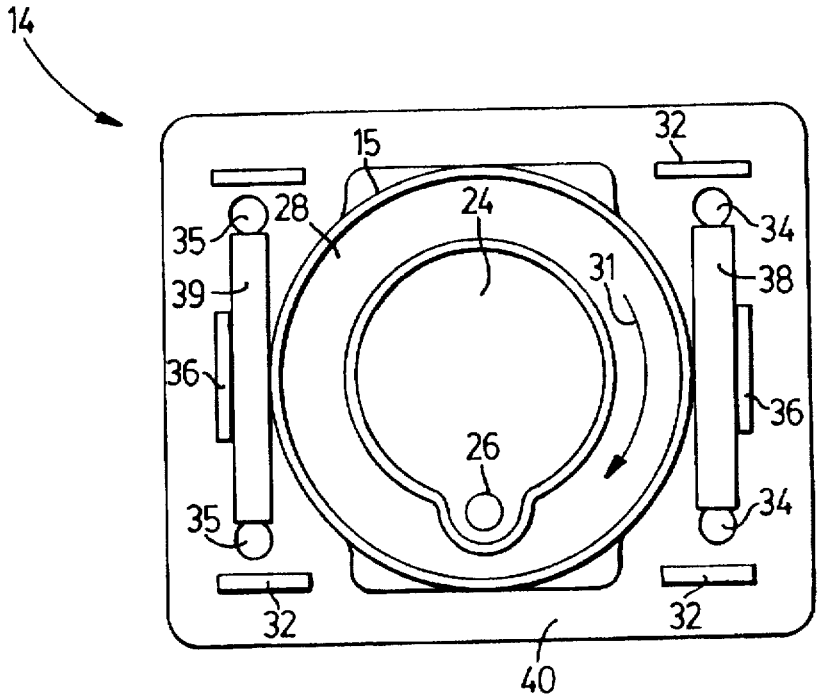
FIG. 3 is a top view of the vibrator of FIG. 2.

Referring now to FIGS. 2 and 3, one of the vibrators 14 is shown in detail. The vibrator 14 preferably takes the form of a commonly available AC electric motor or drive device or brushless DC electric motor or drive device 13 with a housing 15 that is made substantially of moulded plastic. The vibrator 14 includes a rotor 24 which encloses and is powered by the electric drive device 13. The motor can be a low rpm type with a variable speed ranging up to 3600 rpms. An eccentric weight 26 is attached to the rotor 24 of the vibrator 14, which weight causes the vibrator 14 to vibrate when the rotor 24 rotates, this vibration being in the plane of rotation. It will be understood that the eccentric weight 26 could be attached to the rotor 24 as an external component or it could be integrally formed into the body of the rotor 24. The housing 15 can include a circular guard 28, a base 40 and possibly a snap-on cover 30 which encases the rotor 24, thereby ensuring that the rotor 24 can rotate freely without brushing against external materials. In order to facilitate installation of the vibrator into the cushion structure 12 of the massaging device 10, four holes 34,35 are formed through the base 40 of the vibrator 14, and a plurality of ridges 32, 36 extend upwardly a substaintial distance from the base 40. Additionally, two open-sided channels 38,39 are formed in the plastic base 40. It will be apparent from FIGS. 2 and 3 that when power is supplied to the vibrator 14, the rotor 24 rotates in a plane that is parallel to an outer surface 25 of the base 40. This rotation is indicated by an arrow 31. It will be appreciated that the rotor 24 could rotate in a direction opposite of that indicated by the arrow 31.

It will be understood that the cushion structures 12 of the chair 10 could be constructed in a variety of ways as is well known in the art. One advantage of the vibrator 14 of the present invention over prior art vibrators is that it can be easily installed into cushion structures of various types.

Figure 4:
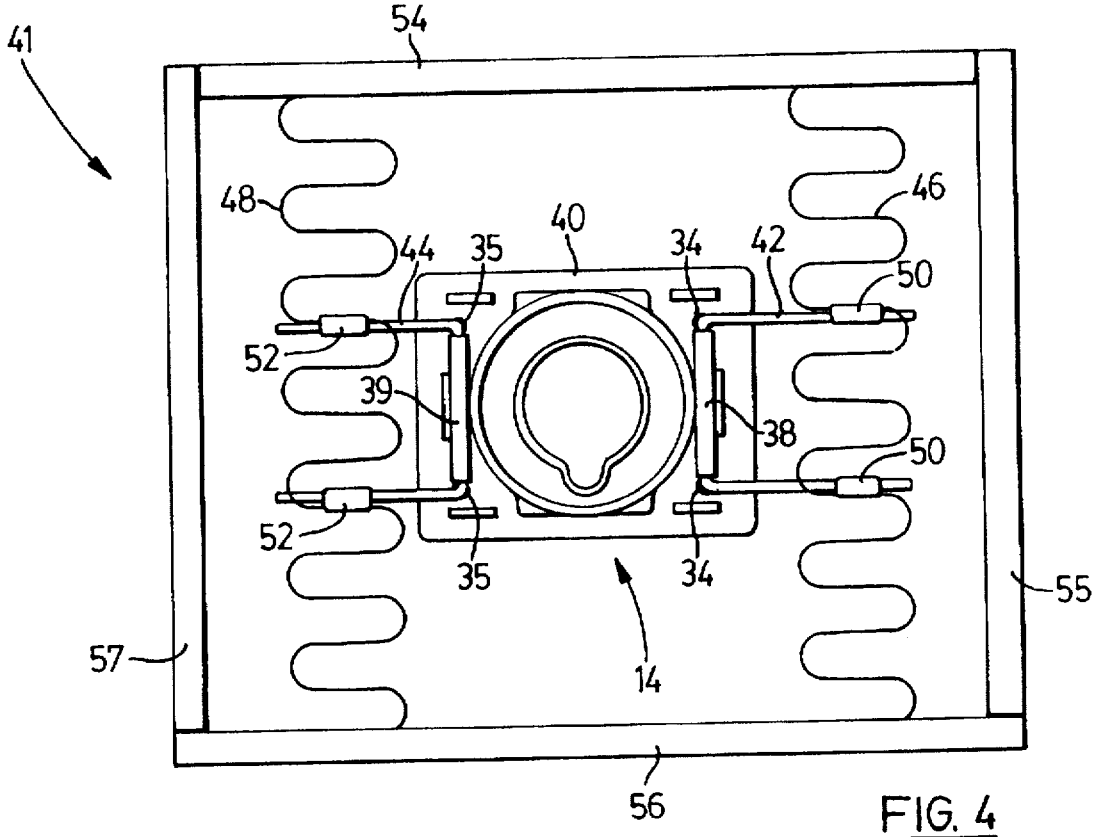
FIG. 4 is a bottom view illustrating one preferred embodiment of a cushion constructed in accordance with the invention.

FIG. 4 is a bottom view of one preferred construction for a cushion structure that could be used in the chair of FIG. 1 for example. Shown in FIG. 4 is a cushion structure 41 constructed of four interconnected rigid frame members 54, 55, 56 and 57, with two parallel frame members 54, 56 being interconnected by at least two sag-resistant springs 46, 48. Flexible cushion material covers the top of the frame members 54, 55, 56 and 57 and the sag-resistant springs 46, 48, thereby providing a user contacting surface. The vibrator 14 is installed in the cushion structure 41 by suspending the vibrator 14 between the two sag-resistant springs 46,48 by means of two preferably U-shaped, substantially rigid wires 42,44. In order to enable to the installation of the wires 42,44, the two open-sided channels 38,39 are used. These channels are open on the side 25 of the base 40. The wire 42 is attached to the vibrator 14 by inserting, from the side 25 of the base 40, the ends of the U simultaneously through the two holes 34. Once inserted, the base of the U of wire 42 slips into the channel 38, and the ends of the U extend outwards from the vibrator 14 in a plane that is parallel to the base 40 of the vibrator 14. The ends of the wire 42 are then connected to the sag resistant spring 46 by means of mechanical metal fasteners 50 such as two sleeves that are secured by crimping. In a similar manner, the base of wire 44 is attached to the vibrator 14 via the holes 35 and the channel 39 located on the opposite side of the vibrator 14, and the ends of wire 44 are attached to the sag-resistant spring 48 with mechanical metal fasteners 52. Once attached to the cushion structure 41 of FIG. 4, the base 40 of the vibrator 14 is upwardly facing and is parallel to the user contacting surface of the cushion structure 41.

It will be understood that once attached to the base 40, the wires 42,44 can each be rotated approximately 160 degrees in a plane above the base 40, which makes it very easy to attach the ends of the wires 42,44 to the sag-resistant springs 46,48 in the manner described above. In operation, the rotor 24 will rotate in a plane parallel to the user contacting surface of the cushion structure 41, thereby inducing relaxing vibrations in the user contacting surface. Of course, more than one vibrator 14 can be installed in a single cushion structure 41 if desired, and the cushion structure 41 may include more than two sag-resistant springs. The method of installation of the vibrator 14 shown in FIG. 4 is a novel method of installation which reduces the complexity of installation significantly as compared to the prior art and enhances the vibratory effect in the chair 10.

Figure 5:
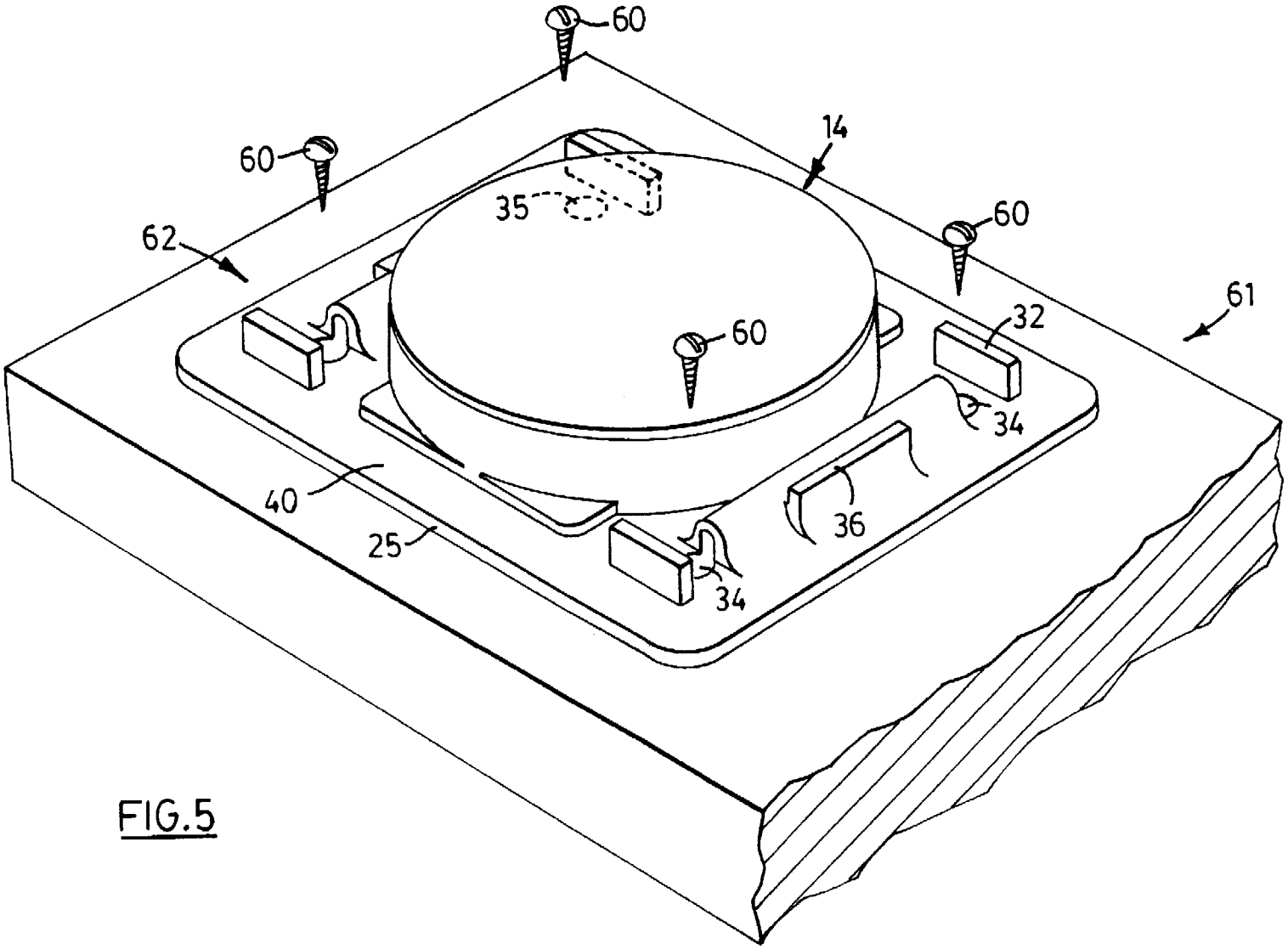
FIG. 5 is a perspective, detail view illustrating one way of mounting the vibrator.

Shown in FIG. 5 is a part of a cushion structure that includes a rigid base 62 made of material such as wood. This base can be used to support a core of cushioning material, such as foam, placed on the wood, and a user contacting surface. The vibrator 14 is attached to the cushion structure by inserting screws 60 through four holes 34,35 in the base 40 of the vibrator 14, and screwing them into the rigid base 62 of the cushion structure 61. When attached to the cushion structure in this manner, the surface 25 of the base 40 of the vibrator 14 is upwardly facing and is parallel to the user contacting surface of the cushion structure. In operation, the rotor 24 of the vibrator 14 rotates in a plane parallel to the user contacting surface of the cushion structure, thereby inducing soothing vibrations in the user contacting surface. Of course, more than one vibrator 14 can be attached to this cushion structure.

Figure 6:
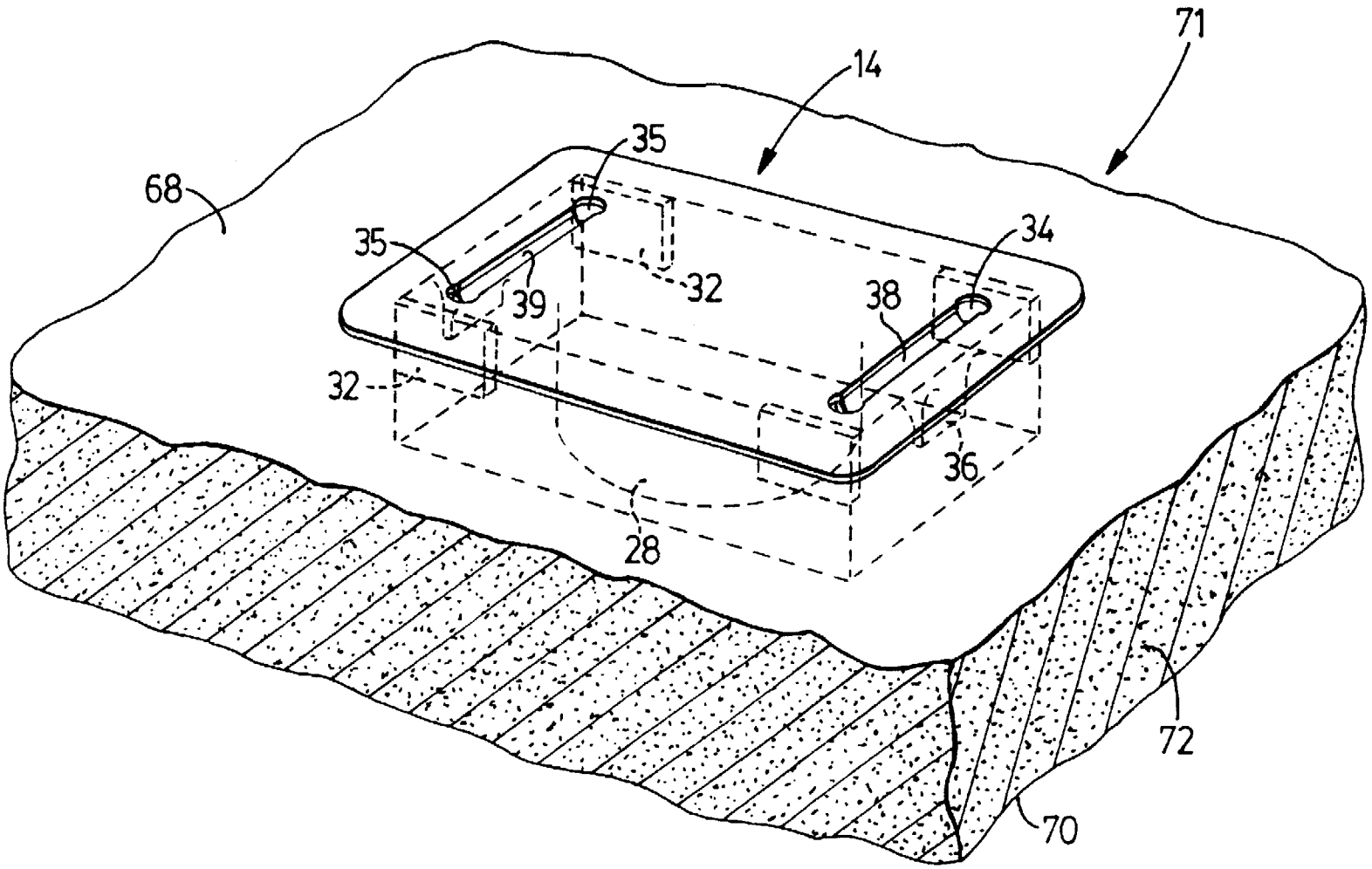
FIG. 6 is another detail view in perspective illustrating another way of mounting the vibrator.

FIG. 6 is a perspective view of another preferred construction for a cushion structure 12 constructed in accordance with this invention. Shown in FIG. 6 is a cushion structure 71 constructed of a semi-rigid material 72 such as foam. The underside 68 of the cushion structure 71 includes a cavity that is dimensioned to allow insertion of the vibrator 14. The vibrator 14 is installed in the cavity by securing the ridges 32,36 and the sides of circular guard 28 to the walls of the cavity by the use of an adhesive material such as glue or Velcro (trade-mark) strips. In operation, the rotor 24 of the vibrator 14 rotates in a plane parallel to a user contacting surface 70 of the cushion structure 71, thereby inducing vibrations in the surface 70, which vibrations move in a direction parallel to the plane of the surface 70. Of course, a plurality of vibrators 14 can be installed in a plurality of cavities located in the cushion structure 71 if desired.

From the above description of the vibrator 14 and the various ways in which the vibrator 14 can be attached to or installed in a variety of cushion structures 12, it will be appreciated that the housing of vibrator 14 has been designed to facilitate easy and cost effective installation into a wide variety of cushion structures 12. Furthermore, the transmission of massage vibrations from the vibrator 14 to the cushion structure 12 is improved by the housing design, which provides for an increased contact surface area over prior art vibrators, which is particularly beneficial when the vibrator is enclosed in a foam or some other semi-rigid cushioning material.

In operation, a massaging device 10 constructed in accordance with this invention can provide soothing vibrations in a plane that is parallel to the user contacting surface of the device. In the preferred embodiment of the massaging device shown in FIG. 1, this reclining chair includes three cushion structures 12, each having a user contacting surface. Each cushion structure 12 could take the form of a cushion structure constructed in accordance with FIG. 4, FIG. 5 or FIG. 6. Referring to FIG. 1, one or more vibrators 14 are installed in each of the cushion structures 12 using any one of the means described above. In the preferred embodiment shown in FIG. 1, only five vibrators 14 are provided. However the number could be much higher. Each of the vibrators 14 is oriented so that the axis of rotation of its rotor 24 is generally perpendicular to the user support surface, with the result that the rotor 24 rotates in a plane parallel to the user support surface of the cushion structure 12 in which the vibrator 14 is installed. It will be appreciated that the number and location of vibrators 14 in the cushion structures 12 of the massaging device 10 will be determined so as to provide a therapeutic and pleasurable pattern of vibrations throughout the user contacting surfaces of the massaging device 10. When power is supplied to a vibrator 14 the rotor 24 of the vibrator 14 begins to rotate in a plane parallel to the user support surface of the cushion structure 12 in which it is installed.

Figure 7:
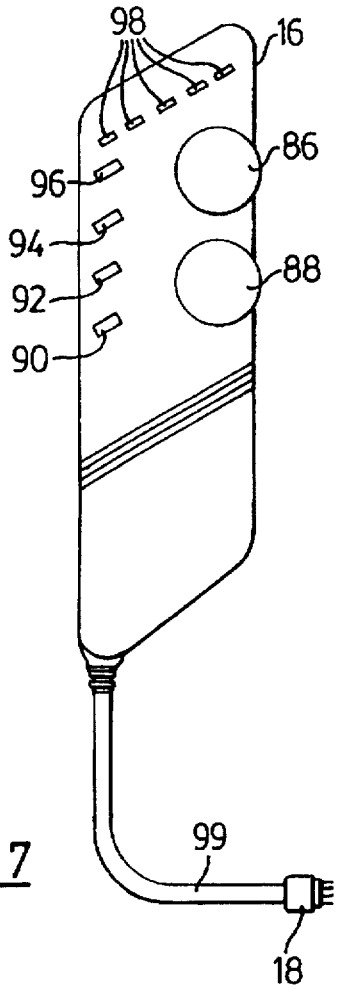
FIG. 7 is a front view illustrating a hand controller for the vibrator(s)
Figure 8:
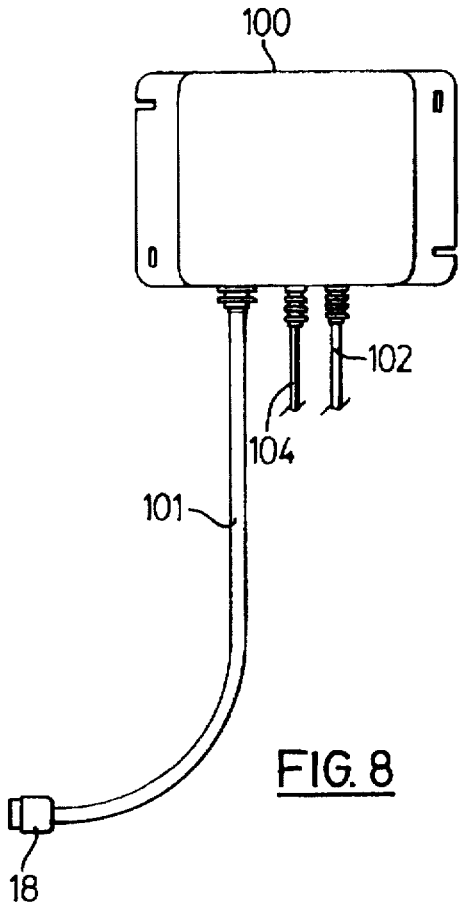
FIG. 8 is a top view of a power connection box for connection to vibrators used in the present invention.
Figure 9:
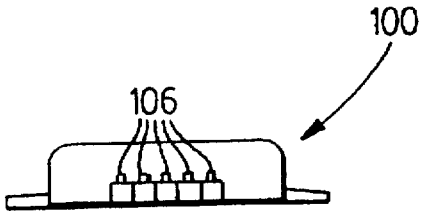
FIG. 9 is a front end view of the power connection box of FIG. 8.

The speed and sequence of operation of the vibrators 14 in the massaging device 10 are preferably controlled by a user through a hand controller, which can be of standard construction. FIG. 7 shows a hand controller 16 that is known in the prior art, the TM-Deluxe, which is available from GeeJay Group International Inc. The hand controller 16 may provide a switch 94 that allows a user to select between an automatic or manual mode of operation. In automatic mode, power is applied to each of the vibrators 14 in the massaging device 10 sequentially from the upper back to lower leg area of the user, then back to the upper back in a continually circulating wave-like manner. The rate or speed of the wave cycle is adjusted by a rotary knob 86 on the hand controller 16. The intensity of the massage, which is a function of the rotor speed of each of the vibrators 14, can be adjusted by a rotary knob 88. In manual mode, a select button 96 will allow a user to manually select and control the operation of a single vibrator 14 or possibly a pair or zone of vibrators 14. The hand controller 16 may include a row of light emitting diodes (LEDs) 98 which indicate which of the vibrators 14 are activated at any given time. Preferably, the hand controller 16 includes a master power on/off switch 90. The hand controller 16 may also include a switch 92 for turning on and off a heating pad that may be installed in the massaging device 10. The hand controller 16 shown in FIG. 7 is attached to a power connection box 100 shown in FIGS. 8 and 9 via a cable 99 and a connector 18. The power connection box 100 is preferably mounted within the structure of the massaging device or furniture 10, and is attached to the power supply 20 via a cable 102. The power connection box 100 contains a plurality of output connector pins 106, each of which allows power to be selectively supplied to a different vibrator 14 in the massaging device 10 depending on what a user has inputted into the hand controller 16. If a heating pad has been installed in the massaging device 10, the power connection box 100 will include an output 104 to provide power to the heating pad. Of course, the action of the vibrators 14 could be controlled in other known ways different than that described herein.

Figure 10:
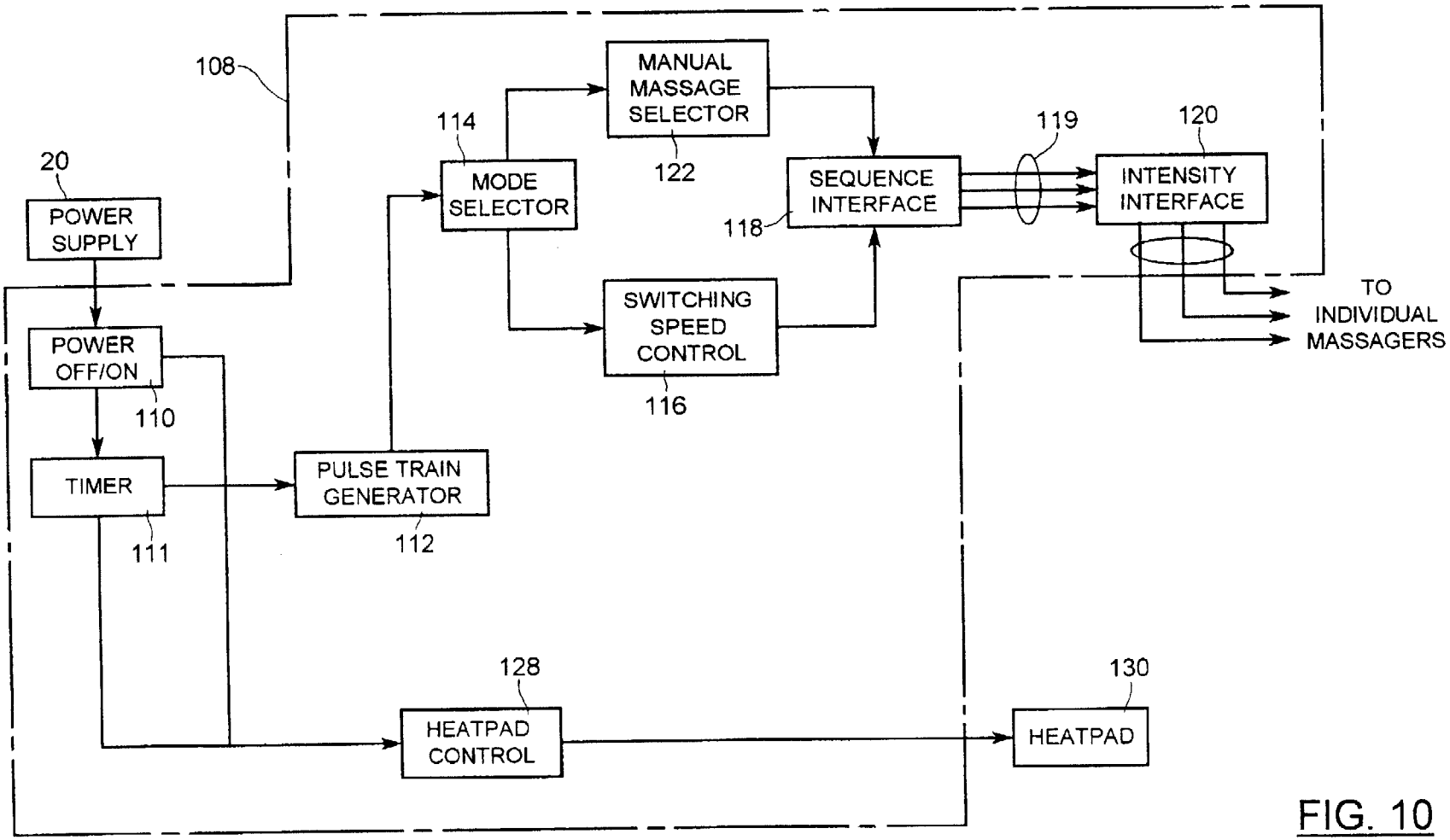
FIG. 10 is a block diagram of the electrical system of the hand controller of FIG. 7 and the power control box of FIG. 8.

Referring now to FIG. 10, a simplified block diagram of the electrical system 108 of the hand controller 16 and the power connection box 100 is shown. Power is supplied to the electrical system 108 by a power supply 20, which can be any one of a number of AC to DC convertor power supplies which are commonly available. The electrical system 108 includes a power on/off means 110 which is controlled by the on/off switch 90 of the hand controller 16. The on/off means 110 may include a timing circuit 111 which will automatically shut the power off after a preselected period of time, such as fifteen minutes. When the power is activated, a DC voltage is supplied to a pulse train generator 112 which produces a square wave pulse train output. The output of the pulse train generator 112 is then inputted to a mode selector means 114 which is controlled by the automatic/manual selector switch 94 of the hand controller 16. If automatic mode is selected, the pulse train is inputted to a switching speed control means 116 which is controlled by the rotary knob 86 of the hand controller 16. In automatic mode, the switching speed control means 116 ultimately controls the frequency of the wave-like cycle of the vibrators 14 in the massaging device of the invention. It does this by adjusting the pulse width of the pulses in the pulse train, which in turn are inputted to a sequence interface means 118. The sequence interface means 118 sequentially activates a series of output lines 119, each of which ultimately is connected to a different vibrator 14 or a zone of vibrators. The rate at which the sequence interface means 118 sequentially activates the output lines 119 is a function of the frequency of the pulses that are inputted to the sequence interface means 118 from the switching speed control means 116. The output lines 119 then pass through an intensity interface means 120 which is controlled by the rotary knob 88 of the hand controller 16. The intensity interface means 120 regulates the amplitude of the voltage being provided to the vibrators 14, thereby determining the speed at which the rotor 26 in an activated vibrator 14 will rotate.

If manual mode is selected by a user, the mode selector means 114 will input the pulse train output of the pulse train generator 112 to a manual massage selector means 122 that is controlled by the select button 96 of the hand controller 16. The manual massage selector means 122 converts the pulse train into a steady voltage that only pulses when the select button 96 is pressed. The output of the manual massage selector means 122 is provided to the sequence interface means 118 which sequentially activates a different one of the output lines 119 each time a user depresses the select button 96 of the hand controller 16, thereby allowing a user to select which vibrator 14 or zone of vibrators is activated at any given time.

The electrical system 108 also includes a heat pad control means 128 which is controlled by the switch 92 of the hand controller 16.

Figure 11:
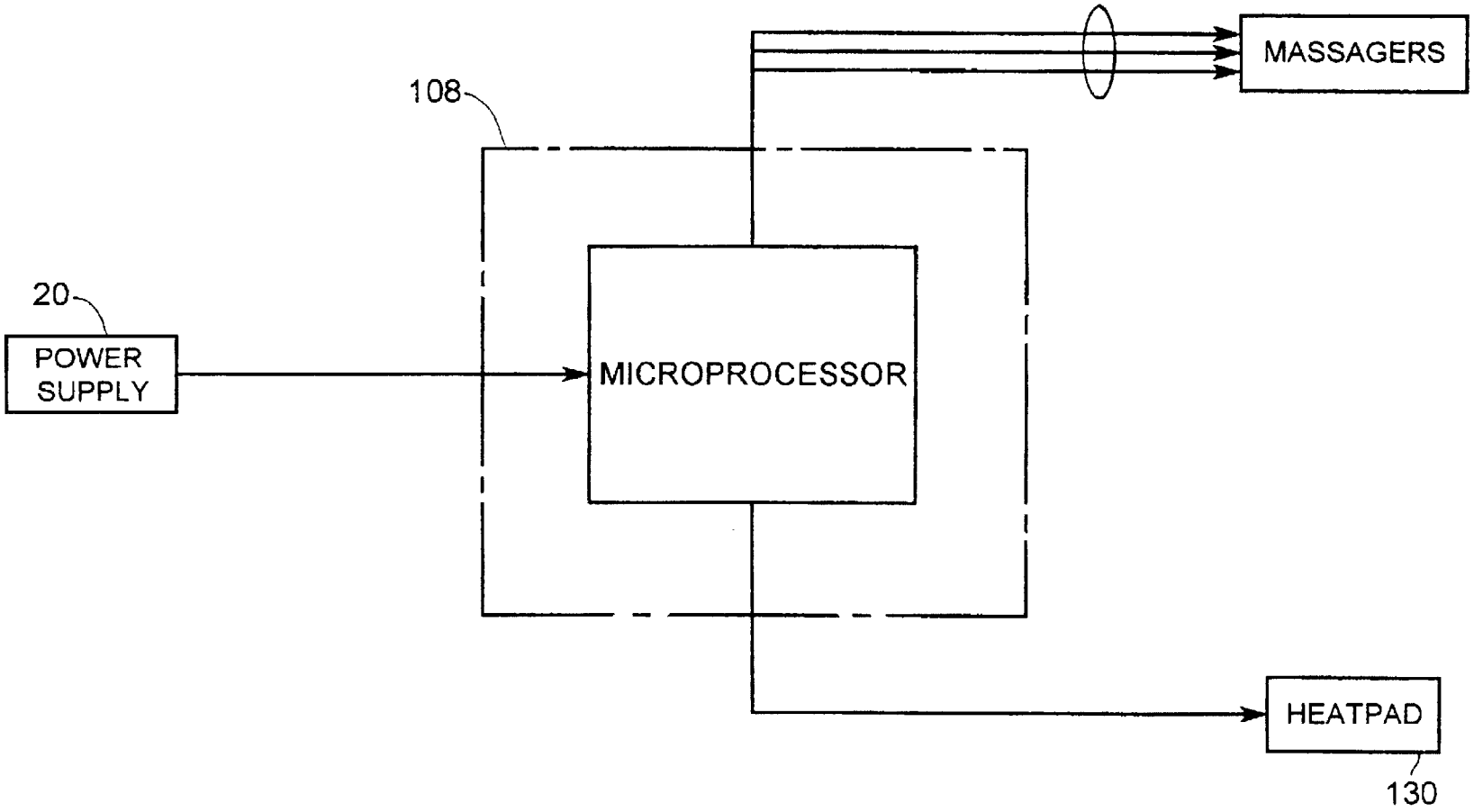
FIG. 11 is a block diagram of another electrical system of the hand controller of FIG. 7 and the power control box of FIG. 8.

It will be appreciated that the electrical system 108 of the hand controller 16 and the power connection box 100 can be made in a variety of known ways using a variety of electronic means that are well known in the art. For example, each of the components comprising the electrical system 108 shown in FIG. 10 could be implemented using discrete logic circuits, or they could be implemented by using a programmable microprocessor, such as illustrated in FIG. 11.

It will be appreciated that with the use of the vibrator 14 and installation techniques herein disclosed in a massaging device or furniture item, one can provide a user contacting surface in which massage vibrations occur at least in a plane parallel to the user and are transmitted throughout a greater portion of the user contacting surface than with prior art massaging devices.

Figure 12:
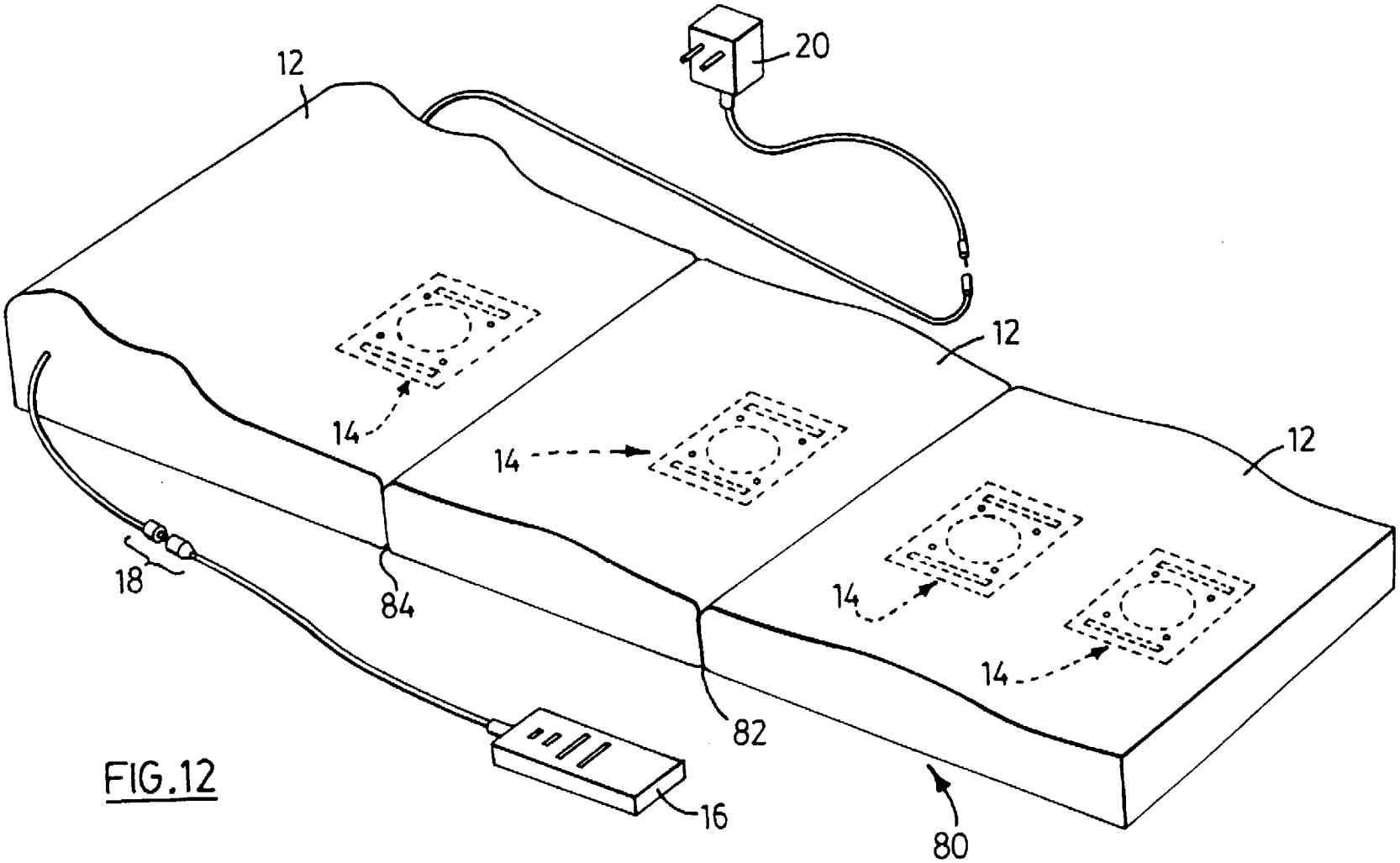
FIG. 12 is a perspective view which illustrates a massaging device in accordance with another preferred embodiment of the invention.

It will be appreciated that the massaging device of the present invention could take a form other than that shown in FIG. 1. For example, FIG. 12 shows another preferred embodiment of the massaging device of the present invention. FIG. 12 shows a massaging device 80 which is a foldable foam or cushion unit comprised of three cushion structures 11 which are foldable at two joints 82,84. The functional operation of the massaging device 80 shown in FIG. 12 is the same as that described herein for the massaging device 10.

Additionally, the massaging device may take the form of portable cushion structures designed specifically for application to a user's head, shoulder, back or foot areas. For each of these portable cushion structures, the functional operation is the same as that described for the massaging device 10.

While various embodiments of this invention have been illustrated in the accompanying drawings and described above, it will be evident to those skilled in the art that changes and modifications may be made therein without departing from the spirit and scope of this invention. All such modifications or variations that are within the sphere and scope of the claims appended hereto are intended to be part of this invention.

I therefore claim:

1. Furniture apparatus for a user to rest or sit on, said apparatus comprising:

an article of furniture for resting or sitting having a user supporting surface comprising flexible material covering a rigid rectangular frame, said frame having opposite frame elements which are interconnected by at least two sag-resistant springs; and at least one vibration device mounted in said article of furniture near said user surface and having an electric drive device, an eccentric rotor connected to said drive device and rotated thereby about an axis of rotation, and a housing in which said drive device is mounted, said rotor enclosing said drive device and said housing including a guard extending circumferentially about the periphery of said rotor, said at least one vibration device being suspended between two of said sag-resistant springs by rigid wire members, wherein said rigid wire members connect said housing to said sag-resistant springs, wherein said at least one vibrating device is mounted in said article of furniture so that said axis of rotation is generally perpendicular to said user supporting surface and, during operation of said vibrating device, the vibrating device causes said user supporting surface to vibrate in directions parallel to said user supporting surface.

2. Furniture apparatus of claim 1 wherein said rigid wire members are pivotably attached to said housing and fixedly attached to said sag-resistant springs.

3. Furniture apparatus of claim 1 wherein said housing is made substantially of molded plastic.

4. Furniture apparatus according to claim 1 wherein said drive device is a variable speed brushless direct current drive device.

5. Furniture apparatus for a user to rest or sit on, said apparatus comprising:

an article of furniture for resting or sitting having a user supporting surface, said article of furniture including a cushion structure composed of resilient material, said cushion structure providing said user supporting surface and including at least one cavity; and at least one vibration device mounted in said article of furniture near said user surface and having an electric drive device, an eccentric rotor connected to said drive device and rotated thereby about an axis of rotation, and a housing in which said drive device is mounted, said rotor enclosing said drive device and said housing including a guard extending circumferentially about the periphery of said rotor, the or each vibration device being received in a respective one of said at least one cavity, the or each housing of said drive device being secured in its respective cavity by adhesive means and including ridge structures extending a substantial distance from said housing and engaging walls of said respective cavity, said adhesive means attaching said ridge structures to said walls of the cavity, wherein said at least one vibrating device is mounted in said article of furniture so that said axis of rotation is generally perpendicular to said user supporting surface and, during operation of said vibrating device, the vibrating device causes said user supporting surface to vibrate in directions parallel to said user supporting surface.

6. A massaging device for providing massaging vibrations to the body of a person comprising:

a cushioned structure having a user contacting surface for supporting at least part of the body of a person, said cushioned structure comprising flexible material covering a rigid rectangular frame having opposite frame elements which are interconnected by at least two sag-resistant springs;

a plurality of variable speed electric drive devices each having an eccentric rotor producing vibrations and a housing in which the drive device is mounted, each housing and its respective drive device being suspended between two of said sag-resistant springs by two U shaped rigid wire members, the base of each wire member being pivotably attached to a respective side of said housing and two ends of each wire member being attached to a respective one of said sag-resistant springs; and a control mechanism for controlling the speed of said drive devices, wherein said housings are attached to said cushioned structure so that each rotor rotates about an axis of rotation that is generally perpendicular to said user contacting surface, said rotor thereby inducing an area of said user contacting surface to vibrate in directions substantially parallel to said user contacting surface.

* * * * *